US011267592B2

(12) United States Patent
Nysted

(10) Patent No.: US 11,267,592 B2
(45) Date of Patent: Mar. 8, 2022

(54) METHOD FOR ADJUSTMENT OF SYSTEM FOR FILLING OF BIG BAGS, AND SYSTEM FOR FILLING OF BIG BAGS

(71) Applicant: Panpac Engineering A/S, Pandrup (DK)

(72) Inventor: Morten Nysted, Pandrup (DK)

(73) Assignee: PANPAC ENGINEERING A/S

( * ) Notice: Subject to any disclaimer, the term of this patent is extended or adjusted under 35 U.S.C. 154(b) by 68 days.

(21) Appl. No.: 16/074,876

(22) PCT Filed: Feb. 8, 2017

(86) PCT No.: PCT/DK2017/050031

§ 371 (c)(1),
(2) Date: Aug. 2, 2018

(87) PCT Pub. No.: WO2017/140318

PCT Pub. Date: Aug. 24, 2017

(65) Prior Publication Data

US 2019/0061980 A1 Feb. 28, 2019

(30) Foreign Application Priority Data

Feb. 17, 2016 (DK) ..... PA 2016 70087

(51) Int. Cl.
*B65B 1/06* (2006.01)
*B65B 43/54* (2006.01)
(Continued)

(52) U.S. Cl.
CPC ..... *B65B 1/06* (2013.01); *B65B 39/02* (2013.01); *B65B 39/06* (2013.01); *B65B 43/54* (2013.01); *B65B 59/04* (2013.01)

(58) Field of Classification Search
CPC ..... B65B 1/06; B65B 39/02; B65B 39/06; B65B 43/54
(Continued)

(56) References Cited

U.S. PATENT DOCUMENTS 1,660,442 A 2/1928 Hampton
4,081,004 A 3/1978 Harris
(Continued)

FOREIGN PATENT DOCUMENTS

BE 831377 11/1975
CH 678613 10/1991
(Continued)

OTHER PUBLICATIONS

Extended European Search Report, Application No. 17 752 715.7, dated Jul. 12, 2019, 7 pages.

*Primary Examiner* — Paul J Gray
(74) *Attorney, Agent, or Firm* — Ware, Fressola, Maguire & Barber LLP

(57) ABSTRACT

A system for (1) for filling of big bags (4) of various heights with material and a method for adjusting thereof, wherein a big bag (4) is to be placed with its filling spout (3) around an outer pipe (6) and the bottom (2) of the big bag (4) rests on an underlying surface (7). The outer pipe (6) is telescopically engaged to a feed pipe (5). The feed pipe (5) is in sections extendible. The feed pipe (5) is designed to fill a determined quantity of material in a vertical stream from an overlying dosage unit (8) via the outer pipe (6) and down into the big bag (4). The feed pipe (5) at its upper connection (5.3) includes at least one radial continuous interface surface design to attach to another feed pipe's (5.2) downward facing rim (5.6) or to the underside of the dosage unit (8.2).

5 Claims, 10 Drawing Sheets

(51) Int. Cl.
*B65B 39/02* (2006.01)
*B65B 39/06* (2006.01)
*B65B 59/04* (2006.01)

(58) Field of Classification Search
USPC ..... 141/10
See application file for complete search history.

(56) References Cited

U.S. PATENT DOCUMENTS

| | | | | |
|---|---|---|---|---|
| 4,182,591 | A | 1/1980 | Stanelle | |
| 4,688,371 | A | 8/1987 | Hecht | |
| 5,771,665 | A | 6/1998 | Nelson et al. | |
| 6,968,670 | B2 * | 11/2005 | Wilson | B65B 1/32 53/502 |
| 2005/0072119 | A1 * | 4/2005 | Griggs | B65B 25/064 53/417 |
| 2005/0217754 | A1 | 10/2005 | Gill et al. | |
| 2006/0032551 | A1 | 2/2006 | Sterner et al. | |
| 2010/0287883 | A1 * | 11/2010 | May | A22C 11/005 53/436 |

FOREIGN PATENT DOCUMENTS

| | | |
|---|---|---|
| CN | 105059574 | 11/2015 |
| DE | 20308483 | 9/2003 |
| EP | 0 095 556 | 12/1983 |
| EP | 2783992 | 10/2014 |
| ES | 2166694 | 4/2002 |
| GB | 2019806 | 11/1979 |
| HU | 227446 | 6/2011 |
| WO | 2008/064652 | 6/2008 |

* cited by examiner

METHOD FOR ADJUSTMENT OF SYSTEM FOR FILLING OF BIG BAGS, AND SYSTEM FOR FILLING OF BIG BAGS

CROSS-REFERENCE TO RELATED APPLICATIONS

This application is a U.S. national stage of International Appl. No. PCT/DK2017/050031 filed Feb. 8, 2017, which claimed priority to Danish Appl. No. PA 2016 70087 filed Feb. 17, 2016, which applications are all incorporated herein by reference in their entireties.

TECHNICAL FIELD

The invention relates to a method for adjustment of a system for the filling of big bags of various height with material.

BACKGROUND

Filling of big bags with, for example, free-flowing material is regularly done in the following manner: Placement and securing of the neck of a big bag airtight around in relation to a feed pipe, a telescopically fitted outer pipe, where the outer pipe adopts a low position corresponding to the height of the big bag, where filling of the material is carried out while the bottom of the big bag is supported on a surface, while the feed pipe feeds material in a vertical stream from an overlying dosage unit and where the neck of the big bag and outer pipe, after filling, are separated. The separation of the neck of the bag and the outer pipe can be done either by manually pulling the neck down, or by telescopically raising the outer pipe along the feed pipe. This method is used on systems that have limited distance between the dosage unit and the surface. Space issues may arise here when the type of system is to be upgraded with robot-assisted placement of the neck of the big bag around the outer pipe.

The method above is described in WO 2008064652.

There is therefore a need to change the system's arrangement and method, so that big bags of varying heights can be used and such that robot-assisted filling of big bags is made possible using older systems with limited construction height.

SUMMARY OF THE INVENTION

It is proposed, according to the invention's method, that the distance between the lower rim of the feed pipe and the dosage unit is adjusted, when changing from a big bag with a specific height between the underlying surface and neck, to a big bag of another height. By changing this distance, it will be possible to adjust the filling height of the system above the bottom of the big bag, and then big bags of widely varying heights can be used in the same system, also even if the system has very limited distance between the dosage unit and the underlying surface.

The advantage of adjusting the distance of the lower rim of the feed pipe in relation to the dosage unit is greatly enhanced flexibility in both older and refurbished systems, as it will be easy to change a system from one big bag type to another, and the difference between the lowest and tallest useable big bag is increased significantly.

In a design for the invention as submitted in Requirement 2, the distance can be adjusted by removing the feed pipe from a bracket on the underside of the dosage unit and attaching a feed pipe of a different length to the bracket. This adjustment ensures that the feed pipe is always uninterrupted along its entire length, and the outer pipe can always be fed unrestricted in the necessary length, up and down the feed pipe.

The underside of the dosage unit, located at a high level, and the significant weight and size of the feed pipe will immediately prevent proposing this type of replacement each time a new big bag is used; however, the invention provides several different solutions that in a surprising way overcome this problem.

The invention proposes that the feed pipe be detached from the bracket and has a carousel magazine added in an empty U-shaped clamp, and that the carousel magazine is turned, and a feed pipe of another length is attached from a second U-shaped clamp in the carousel magazine and is attached to the bracket. Here it is easy to set up this carousel magazine with a vertical turning axis, just below the bracket on the dosage unit, and with a U-shaped clamp on a sliding device or corresponding mobile device, such that the clamp can be slid to and from the bracket, when the carousel is turned so that the relevant U-shaped clamp is pointing towards the bracket. An empty U-shaped clamp can thereby be brought into position below a downward-pointing upper flange on a feed pipe, so that the pipe can be released and the weight of it is transferred to the U-shaped clamp on the sliding device. The sliding device is then pulled into the centre of the carousel and the carousel turns, so that a pipe of another length, held in the second U-shaped clamp, is brought into position near the bracket. This new pipe can be moved on the sliding device until it is in line with the bracket, and the clamps at the bracket can be activated, so that the pipe is pressed with its outward-facing flange towards the bracket. The system is now ready for production with the new feed pipe. The functions described can be carried out manually, e.g. by one person, who can stand on a suitably constructed platform at the side of the carousel. Alternatively, these operations can readily be automated using various types of actuators, sensors and some control technology, so that they are performed fully automatically by the system. The control system in this case is either integrated or connected to the robot unit's control unit.

In another design of the invention, the outer pipe is lifted all the way along the feed pipe to the outer pipe system to an upper flange on the feed pipe. Thereafter, the outer pipe is removed and the outer pipe is lowered all the way down until the lower rim of the feed pipe or outer pipe is on a level with the underlying surface, then the feed pipe is lifted out of the outer pipe and a feed pipe of another length is lifted up into the outer pipe, whereafter this is lifted up to the new feed pipe's system to the bracket and is attached here. This use of the movement of the outer pipe up and down to transport a free unattached feed pipe requires an apparatus that raises or lowers the outer pipe to be installed; however, this apparatus can be arranged in many different ways, and when it is first installed, it will be quite easy and convenient to replace the feed pipe, without requiring an installer or another member of personnel to climb to a height and handle heavy objects.

In an alternative design, the distance of the feed pipe from the underlying surface is increased or decreased by replacing a section of the feed pipe. Here, the feed pipe is fitted with a lower section and a possible intermediate section between the bracket and upper rim of the lower section. All intermediate sections can be separated by outward-facing common flanges at each end, so that they can be connected at the upper end, either attached automatically via clamps here or by a second intermediate section. At the bottom, they can be attached with either a second intermediate section or with a lower section of the feed pipe. The bottom section of the feed pipe can thus be connected either directly to the bracket or to an intermediate section. It is of course possible to bring together the number of intermediate sections that are required as extensions to each other and connect them to the bottom section of the feed pipe while this is resting with its upper rim on the upper rim of the outer pipe and thereafter transport the complete feed pipe to the system between the outward-facing flange and bracket of the topmost feed pipe and then activate the clamps, so that the bracket and flange are connected. From here, filling can be restarted, this time with one or several extra/fewer intermediate sections between the bottom feed pipe section and the bracket.

The invention also concerns a system for filling of big bags with more or less free flowing materials, where a big bag can be placed with the neck around a feed pipe, a telescopically fitted outer pipe, where at the same time the bottom of the big bag is supported on a surface, and the telescopic movement of the outer pipe, up and down, brings it's lower rim down into and alternatively up and free of a big bag, where the feed pipe is arranged such that it adds a measured amount of material in vertical stream from an overlying dosage unit and through the outer pipe and down into the big bag.

What is new and special with this invention is that the feed pipe includes as a minimum a radially continuous interface surface at its topmost connection arranged on a disconnectable attachment to a second downward-facing rim of a feed pipe and/or to the dosage unit underside. Note that the radially continuous interface surface must preferably not be within the pipe's inner diameter, as this can present an obstruction to the material flow within the pipe. Particularly during the transport of material vertically down into the big bag, there is a risk that the simultaneous upward flow of gases that need to be extracted from the big bag at the same time as filling can be disturbed by objects within the inner diameter of the pipe. Otherwise, the interface surface can be arranged in any imaginable way: it can be a screw or tension flange, where an exterior ring pushes two flange components together on two adjacent pipe sections, or it can be corresponding outward-facing flanges that have holes with bolts through so that two adjacent flange components can be connected together. It may also be possible to use threaded components with exterior threads on one end and corresponding interior threads on the opposite end. However, it should be noted that in such case the attachment under the dosage unit must be arranged such that it corresponds to a threaded part of an assembled feed pipe.

In one design of the invention the feed pipe is attached (but removeable) to a bracket on the underside of the dosage unit, in that on the bracket there is at least one moveable component for proper securing of the feed pipe to the bracket. Typically, the moveable component will be a clamp, that can clamp onto a flange at the upper end of the feed pipe, and push this flange to attach to the bracket. As stated, there are other possibilities for attaching the feed pipe to the bracket; however, a moveable clamp interfacing with a flange on the feed pipe is preferred, as this construction is quite easy to mechanise with one or several actuators, which move the clamps in a suitable direction, so that they push the feed pipe onto the bracket. Actuators, whether electrically powered or pneumatically driven, are easy to control from a central control unit, and they are mass-produced items that are correspondingly cheap to obtain.

In a further design, a carousel magazine has been developed for feed pipes at the dosage unit, such that a feed pipe is available in a vacant space in the carousel magazine, and such that the carousel magazine can revolve and another pipe is removeable from another space in the magazine and can be attached to the bracket. The carousel magazine has a vertically revolving axis and magazines are fitted along the peripheral circumference of the magazine. The Magazine can effectively be located with its turn axis forward of, but parallel with an attached feed pipe centre axis, such that a radial this placement in a horizontal plane in relation to the centre axis can bring a feed pipe located in a space in the carousel magazine to a position below the fastener, where the pipe can be connected to the attachment with one or several clamps. These types of operation are easy to automate, so that they can be performed by suitable moving devices controlled by a central control unit.

In a further design of the invention, the outer pipe's movement up and down is facilitated during the filling cycle by an elevator located along the feed pipe, where the elevator runs up to an attachment on the underside of the dosage unit. This type of elevator can be used for transport of the feed pipe up to the attachment, where the previously mentioned clamps are adjusted to clamp under an upper outward-facing flange on the feed pipe, so that this flange is held against a corresponding flange below the underside of the dosage unit. It is preferable that the elevator at the same time represents the movement mechanism that moves the outer pipe up and down during the filling cycle for big bags. It may be appropriate for the elevator to run all the way down to the underlying surface, such that an operator can pick up a feed pipe that is resting with its outward facing flange against the upper rim of the outer pipe, and replace it with the feed pipe of a different length. Doing so will avoid personnel having to manoeuvre and remove and attach a feed pipe on the underside of the dosage unit, which is typically located at a height. The outer pipe will then be permanently attached and follow the elevator's movement upwards and downwards.

In an alternative design, the feed pipe encompasses a lower section of a predetermined length, along with none, one or several sequential sections between the lower section and the dosage unit. The aforementioned elevator and the automatic clamps below the dosage unit can then be used, when the number of sections between the lower section of the feed pipe is to be changed. However, the use of a sectioned feed pipe also provides an opportunity, alongside other systems for the transport and replacement of parts of the feed pipe, when the distance between its lowest rim and the surface is to be changed in an easy and convenient manner.

BRIEF DESCRIPTION OF THE DRAWINGS

The invention will be explained hereafter with references to drawings, as follows.

DETAILED DESCRIPTION OF THE INVENTION

Figure 1:
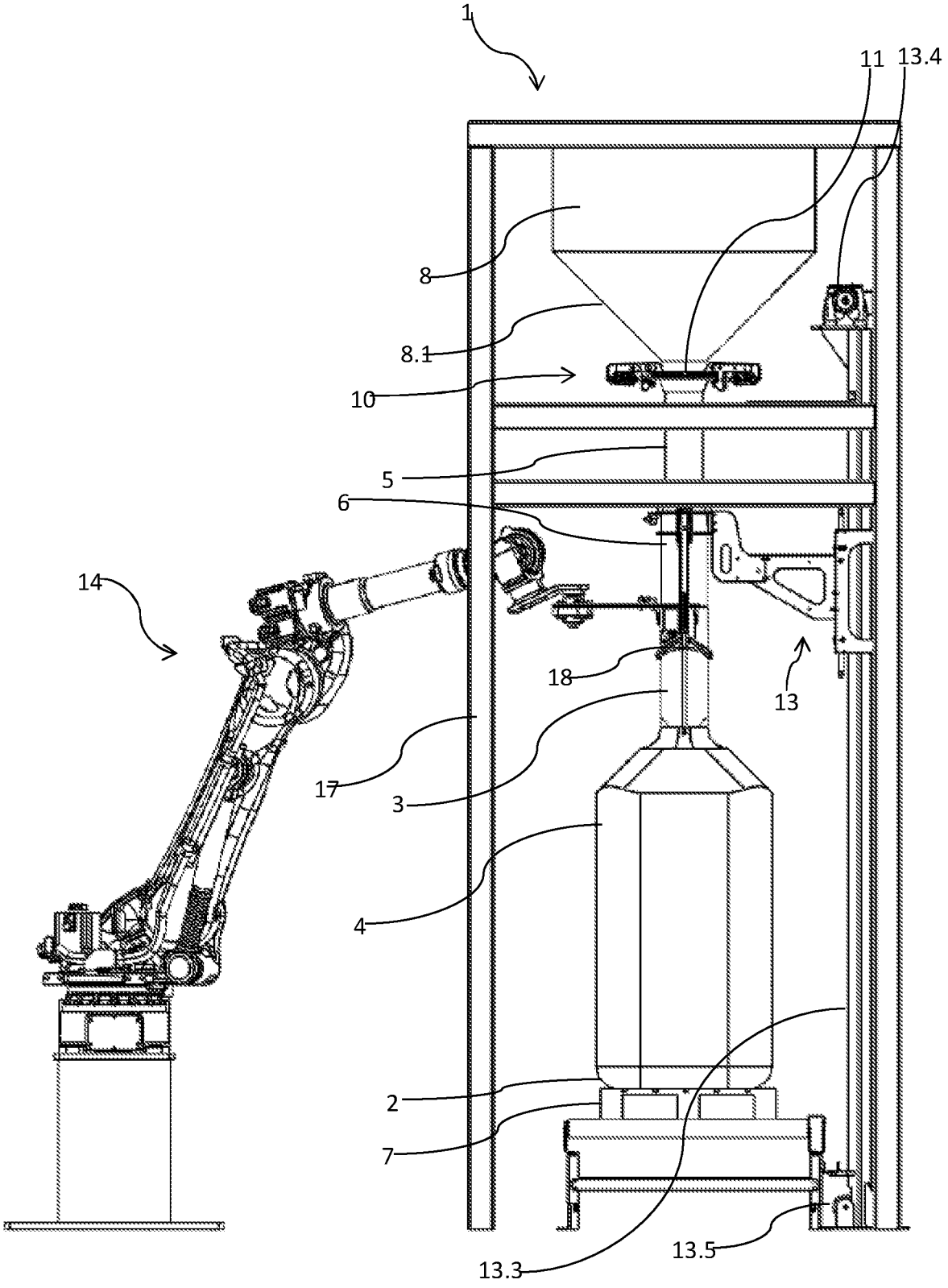
FIG. 1 shows a side image of a filling system according to the invention along with an adjacent robot unit.
Figure 7:
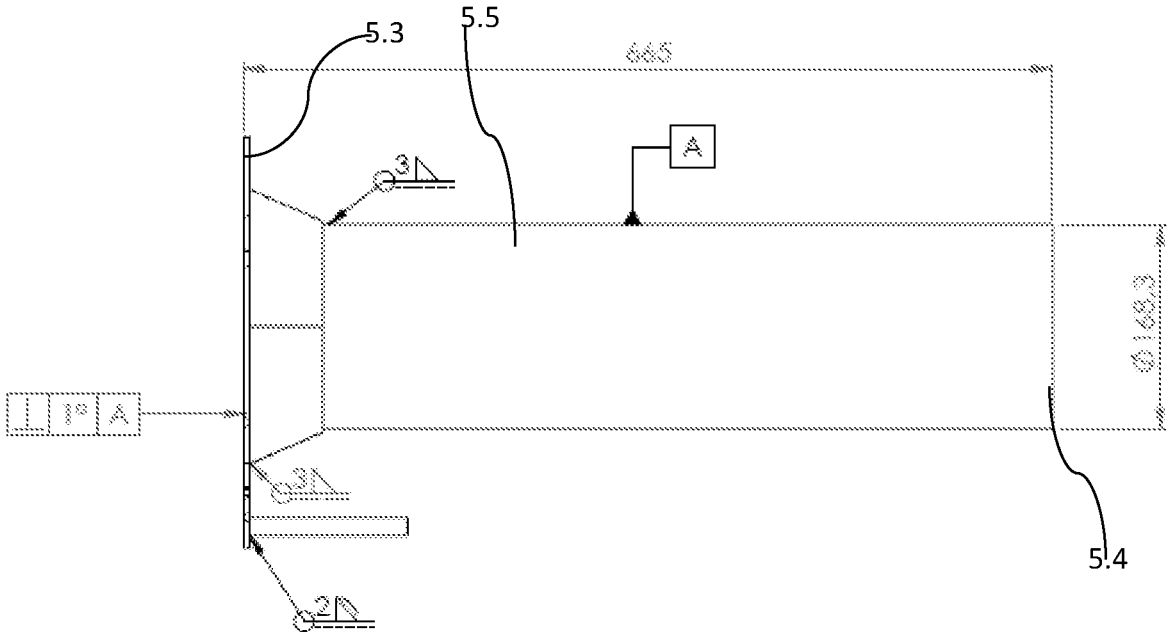
FIG. 7 is a dimension feed pipe.
Figure 11:
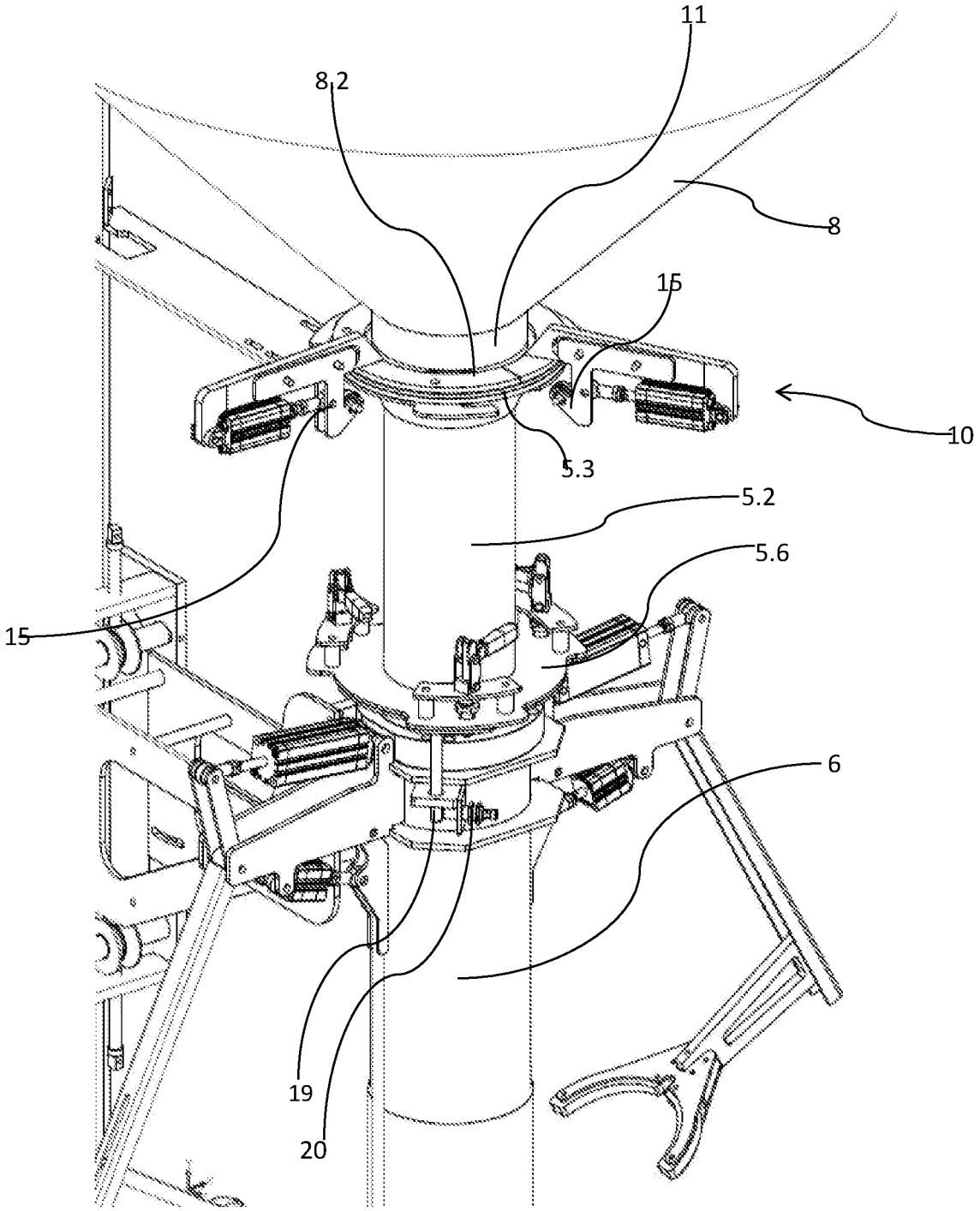
Figure 12:
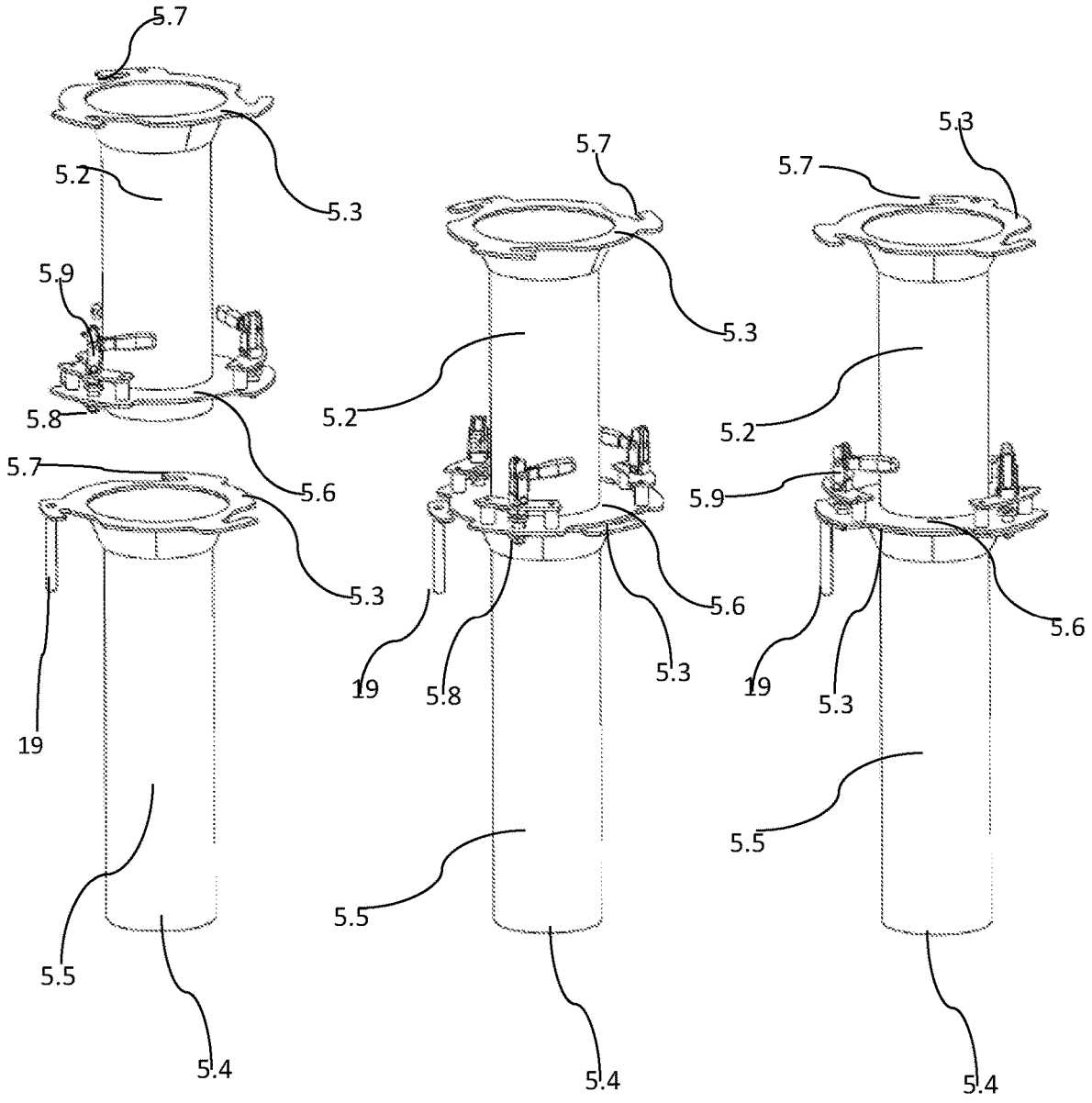

In FIG. 1, a system 1 is shown for filling of big bags 4 with more or less free-flowing material. Examples of materials can be powders such as flour, milk powder, cocoa powder, cement, chalk powder or fuel ash, but also other various types of animal feedstuffs, stone, ballast, sand or gravel or substances such as fully or partially dried sludge or filter mass can be relevant. The system 1 encompasses a feed pipe 5 and an associated telescopically attached outer pipe 6. Big bag 4 has a neck at the top, herein called beck 3, which is designed with an opening diameter such that it is just possible to feed the outer pipe 6 down into big bag 4 through the neck of the bag. Big bag 4 is attached and retained around the outer pipe 6 while at the same time the bottom of the big bag 2 rests on the surface 7. The outer pipe's 6 telescopic movement upwards and downwards brings the mouth of the outer pipe 6 up and free of big bag 4 neck 3, and when the outer pipe 6 is down in bag 4 prescribed amount of material is fed through feed pipe 5 in a vertical stream from an overlying dosage unit 8 through the outer pipe 6 and down into big bag 4. After dosage of material into big bag 4 the neck 3 is released from the outer pipe 6, and the outer pipe 6 is lifted upwards and the neck 3 of the of big bag 4 is closed or sealed by welding and big bag 4 is now ready for further transport to for example a warehouse, for labelling or for delivery. In the example shown the underlying surface 7 is a pallet, which in turn is standing on a roller belt conveyor, so that the transport of the pallet 7 with the filled big bag 4 is made easy and uncomplicated by activating the roller belt conveyor. Pallet 7 will in many situations be replaced by a conveyor belt or rollers, on which the big bag can stand during filling, and allow the filled big bag to be moved easily to a suitable destination. The ongoing transport system, and for example pallet automation are not shown here, but may be a part of surrounding functions in relation to the system. If this type of system is manually controlled, the movement of the outer pipe 6 upwards and downwards can be replaced by manual removable of big bag 4 after filling is completed. As shown in FIG. 7, the feed pipe 5, at its top connection has a radially continuous interface surface 5.3. The interface surface 5.3 can be made to attach to another feed pipe's downward facing rim 5.6 as shown in FIG. 12, and/or made to attach to the underside of the dosage unit 11 as shown in FIG. 11.

Figure 6:
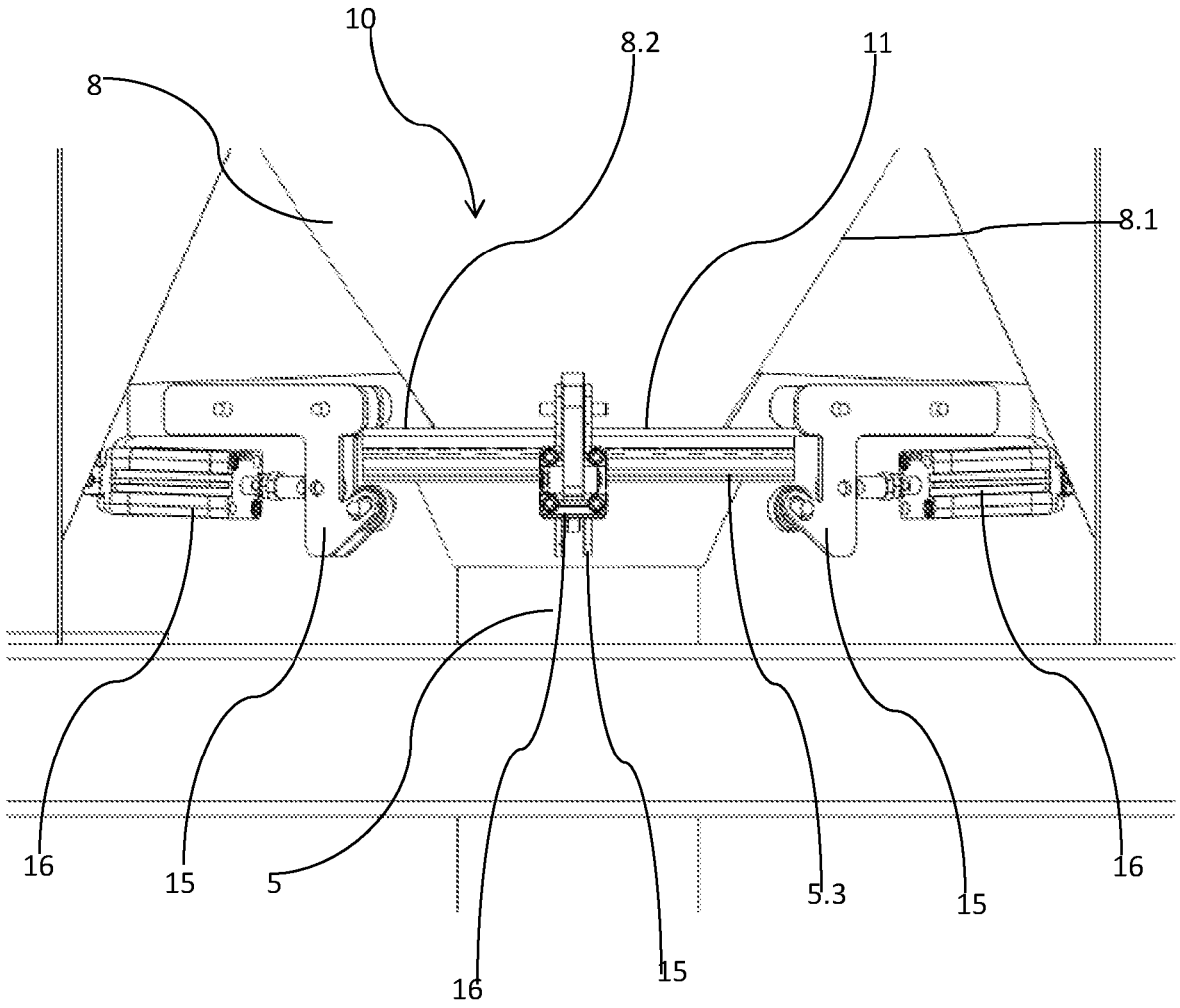
FIG. 6 shows a detailed section with three clamps.

In FIG. 6, the dosage unit 8 is shown with a funnel formed pipe 8.1, which at the lower end is connected on its underside to a radial flange 8.2 and the feed pipe is attached (yet removeable) to the flange 8.2. The flange 8.2 is therefore an attachment for feed pipe 5. On the underside 11 of the dosage unit 8 is attached a movable clamp 15, which is moved by an actuator 16, these are shown a number of times along the flange 8.2. The actuator 16 is set to move the clamp 15, so that it either pushes the feed pipe's radial continual interface surface 5.3 into the flange 8.2, or releases the feed pipe 5. Normally, 3 clamps will be fitted with associated actuators; however more or fewer can be fitted, and there may be a common actuator or an actuator associated with each clamp, as shown here.

FIG. 7 shows a feed pipe 5 to a relatively large big bag corresponding to 1000 kg of material, and the pipe is then correspondingly short, namely 665 mm. The outer diameter of the pipe itself is 168.3 mm and the total diameter of the flange 5.3 is 300 mm. The flange 5.3 incorporates a conical piece, which connects the radially continue as part of the flange 5.3 with the appropriate section of pipe, such that there will be more space for the clamps. A corresponding pipe for use in a system for filling bags of smaller height, e.g. bags designed for 500 kg of material will have the same dimensions, but will just be longer, such that this type of pipe's total length will be 2064 mm.

Figure 8:
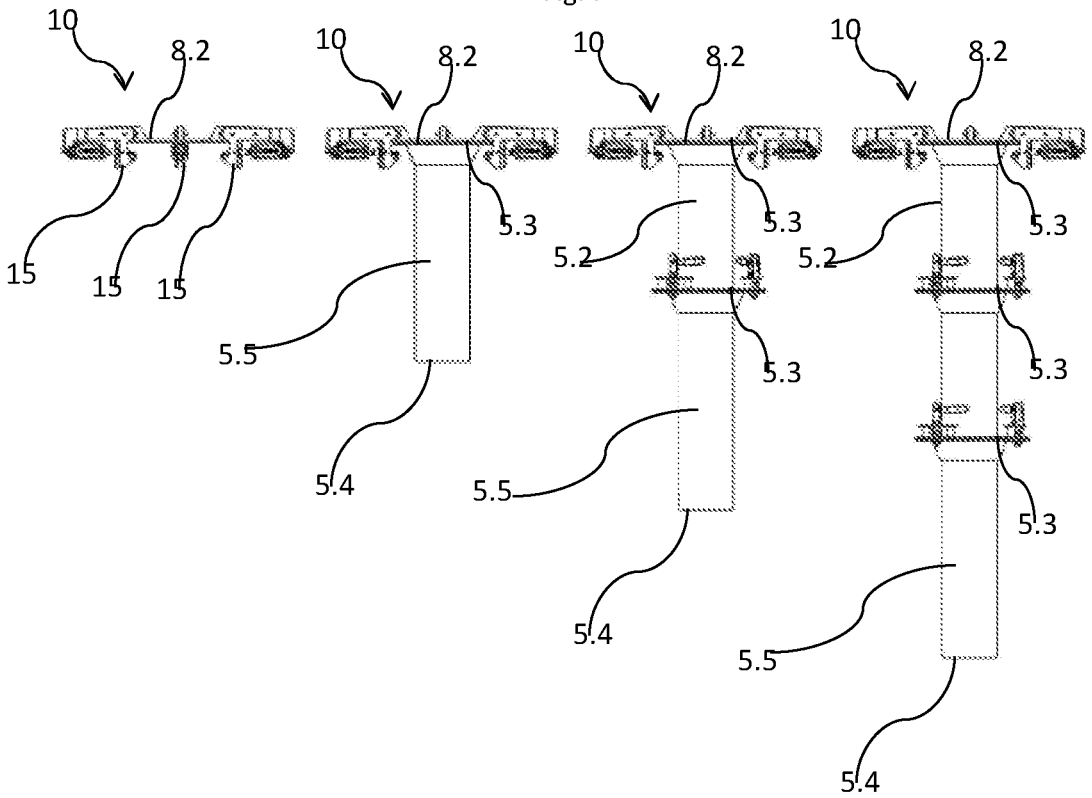
FIG. 8 shows the attachment either without the pipe, or with a bottom lower feed pipe, or with a bottom feed pipe and extra section, or with the bottom feed pipe and two extra sections, FIG. 9. shows a carousel magazine to feed pipe viewed from the side, FIG. 10. shows the carousel magazine in FIG. 8 viewed from above, FIG. 11. shows the interface between the bottom feed pipe and the elevator and the interface between the signal pin on the feed pipe and the signal sender on the outer pipe, FIG. 12. shows a section of a feed pipe and the lower section of a feed pipe in three positions relative to one another.

In FIG. 8, a feed pipe 5 is shown comprised of several sections, where a bottom pipe 5.5 is always concluded with a simple downward facing rim 5.4 and where any sections between the bottom section 5.5 and the attachment 10 have a lower flange 5.6 at the bottom (see FIG. 12), which fits to an upper radially continuous interface surface 5.3, which all of the pipe sections have. Thus, the length of the feed pipe can be changed by changing the number of intermediate pipe sections between the underside 11 of the dosage unit and a lower section 5.5. The interface surface 5.3 is here shown as a flange; however, this could also be arranged as a threaded section or another type of coupling, However, it must be noted that the interface surface on the flange 5.3 must not be within the pipe's inner diameter as this may interfere with the stream of gas passing up along the inside of the pipe at the same time that material is moving down into the bag in a central stream in the centre of the feed pipe 5. As the automated filling cycle for big bags dictates, that the outer pipe 6 is moved upwards and downwards along the feed pipe, the bottom section 5.5 has the shortest length possible in order for the system to function. The introduced extension sections can however be of a random length.

The feed pipe must be very stable and is constructed from metal and has quite a weight, so that it is not easy to manoeuvre. Therefore, for replacement and/or extension of the pipe, several solutions are proposed.

Figure 4:
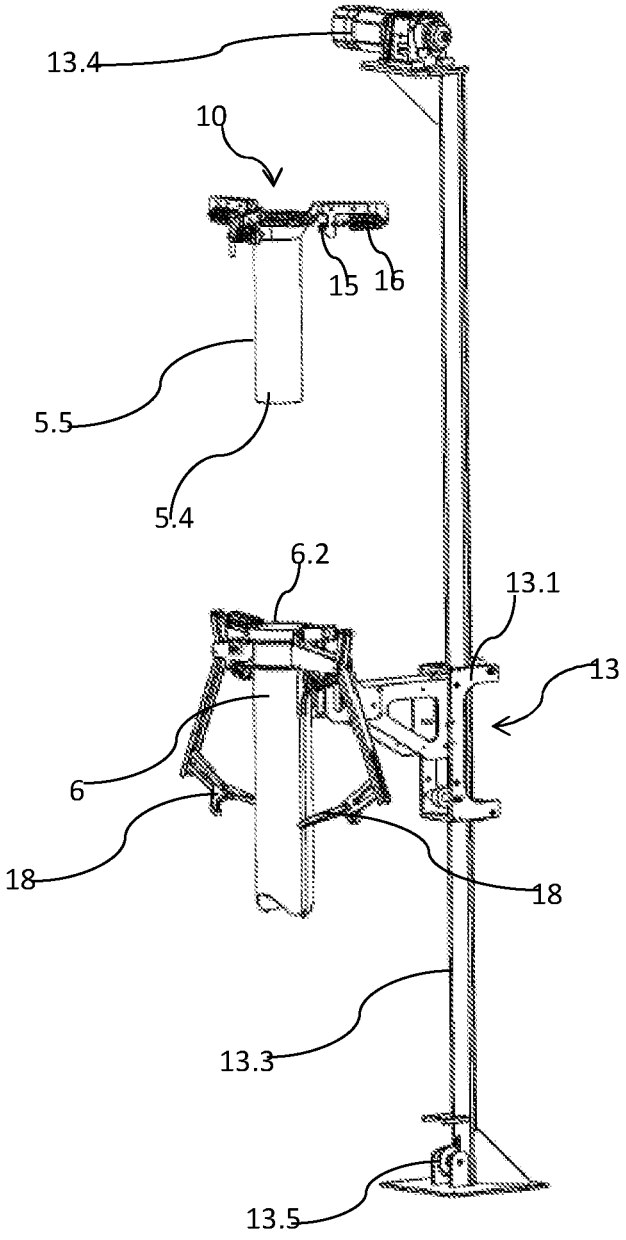
FIG. 4 is a 3D representation of the elevator part and the outer pipe shown in FIGS. 1, 2 and 3.
Figure 9:
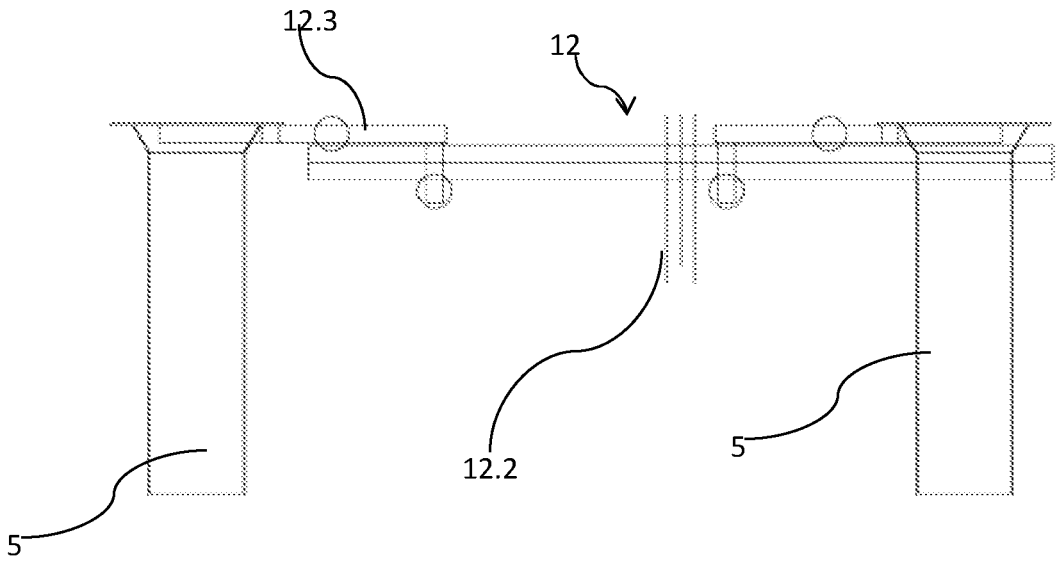
Figure 10:
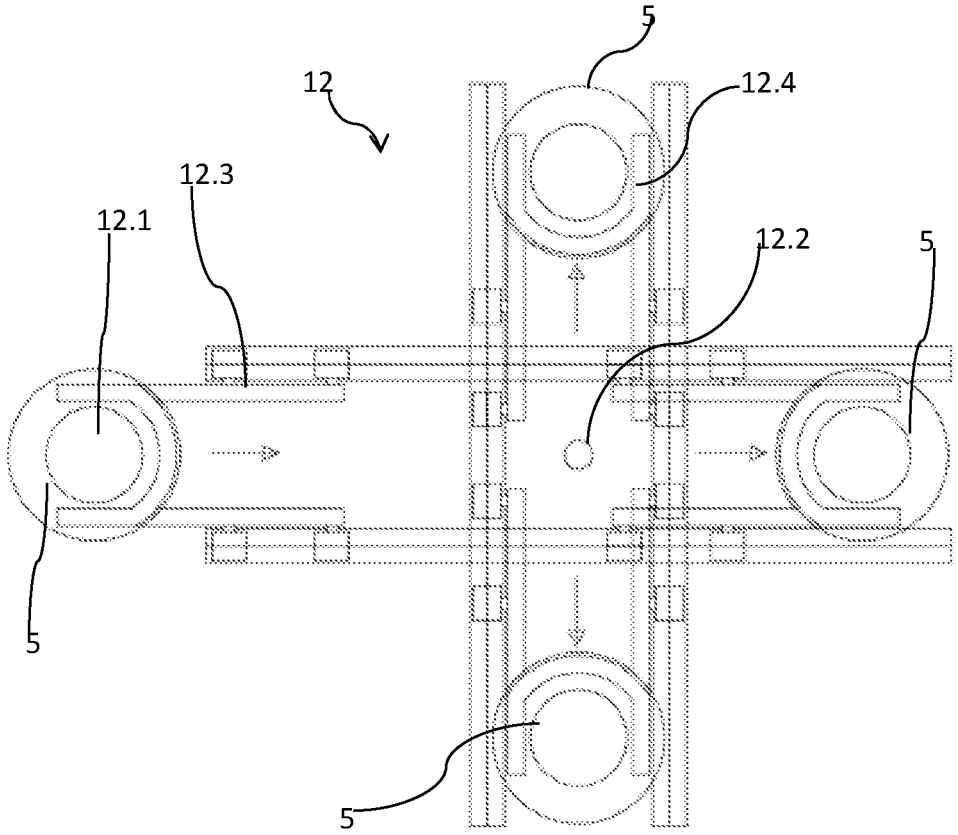

The first solution includes as shown in FIG. 9 and FIG. 10, a carousel magazine 12 for a feed pipe connected to the underside 11 of the dosage unit, such that a feed pipe 5 can fit to a space in the carousel magazine 12, which can also be turned around a vertical axis 12.2, such that another pipe can be allocated from another space in the magazine 12 and attached to the bracket 10. The magazine may be constructed of any size with any number of spaces; however, in the illustrations in FIG. 9 and FIG. 10, 4 spaces are allotted. Each pipe is attached to a slider 12.3, that can be moved radially and horizontally in relation to the carousel's turn axis 12.2. When a pipe is to be replaced, the carousel turns so that an empty slider is brought to the underside 11 of the dosage unit, and the slider 12.3 is moved forward such that a U-shaped clamp 12.4 is placed underneath the feed pipe's radial interface surface 5.3, thereafter the clamps 15 are released and the pipe is clamped on the outer flange 5.3 by the U-shaped clamp 12.4. The pipe 5 can now be transported with the slider 12.3 away from its position below the dosage unit 11. Thereafter, carousel 12 can be turned and a pipe of another length can be installed. The four feed pipes as shown in FIG. 8 will ideally each have a different length and will thereby correspond to a big bag each with a specific height.

In another solution shown in FIG. 1-FIG. 5, the system incorporates an elevator 13, that is designed to carry out two different tasks, where the first task is to remove the outer pipe 6 up and down the feed pipe 5 during an automated filling cycle, and the second task is to lift the feed pipe 5 down from its location below the dosage unit 8 and to bring another feed pipe up to the attachment 10. In order to perform these two tasks, the elevator 13 is attached along the feed pipe 5 and runs all the way up to the attachment 10 on the underside of the dosage unit 11. The elevator 13 can be fitted in many different ways, as is the case for elevators, and in the example shown this includes an elevator carriage 13.1 with wheels 13.2 that is designed to run along vertical rails 13.3 as the elevator carriage's weight is supported by a cable or a chain with an associated drive motor 13.4. The chain is not shown in illustrations, but it is a fully conventional chain forming a closed ring around the indicated chain puller and around cog 13.5 below (best shown on FIG. 4) and attached to the elevator carriage 13.1 in the conventional manner.

Figure 2:
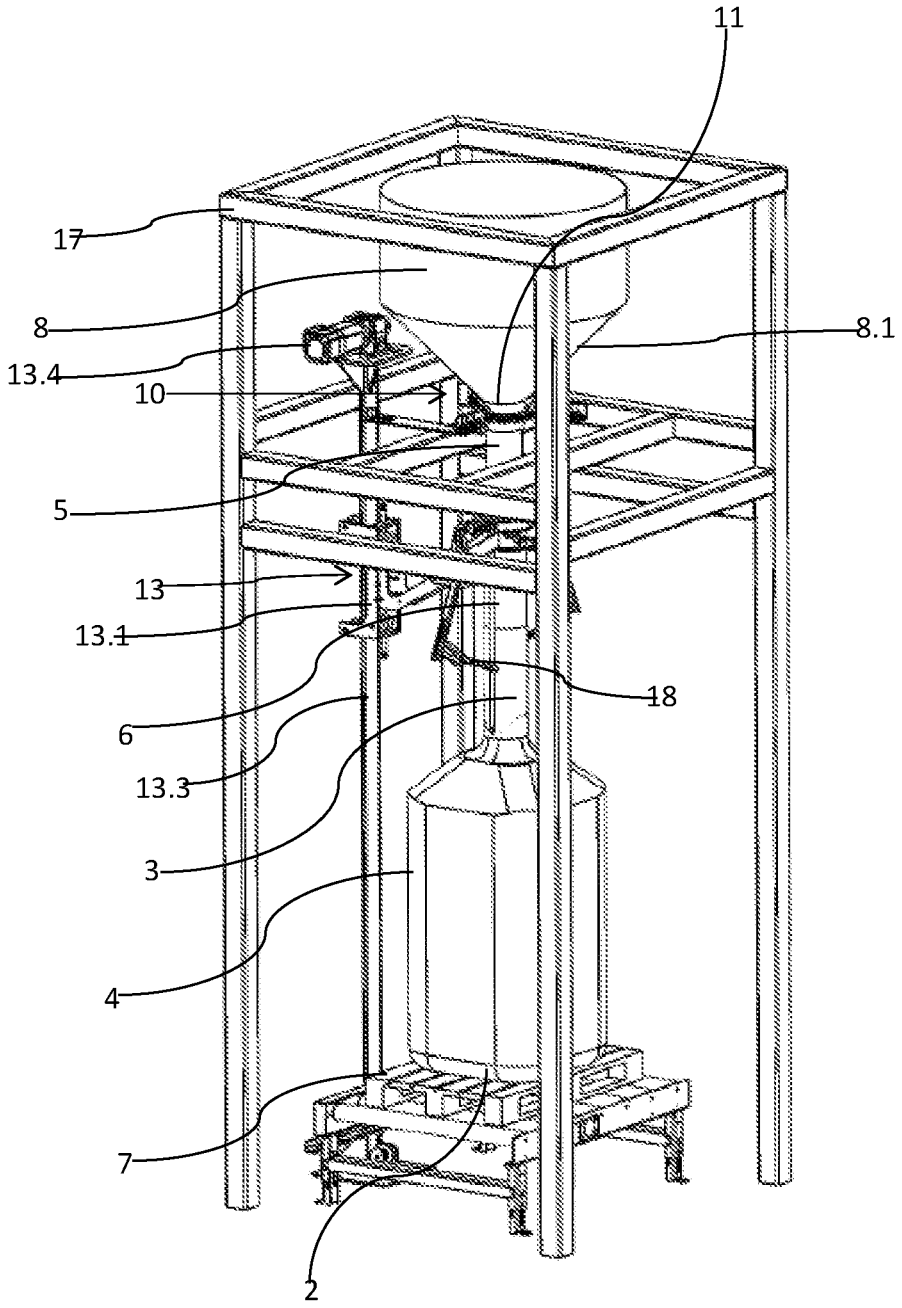
FIG. 2 shows the filling system in FIG. 1 in a 3D version below the robot.
Figure 3:
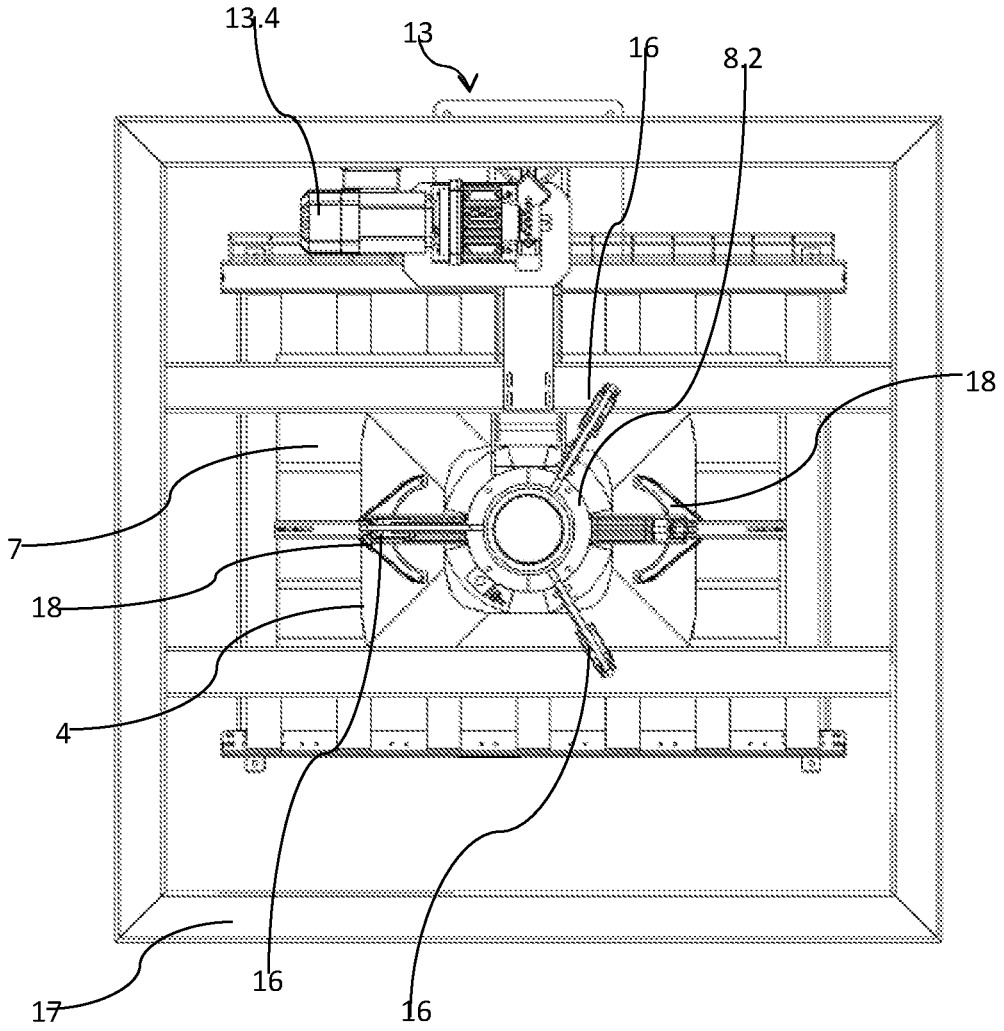
FIG. 3 is the filling system in FIGS. 1 and 2 viewed from above, but without the dosage unit.
Figure 5:
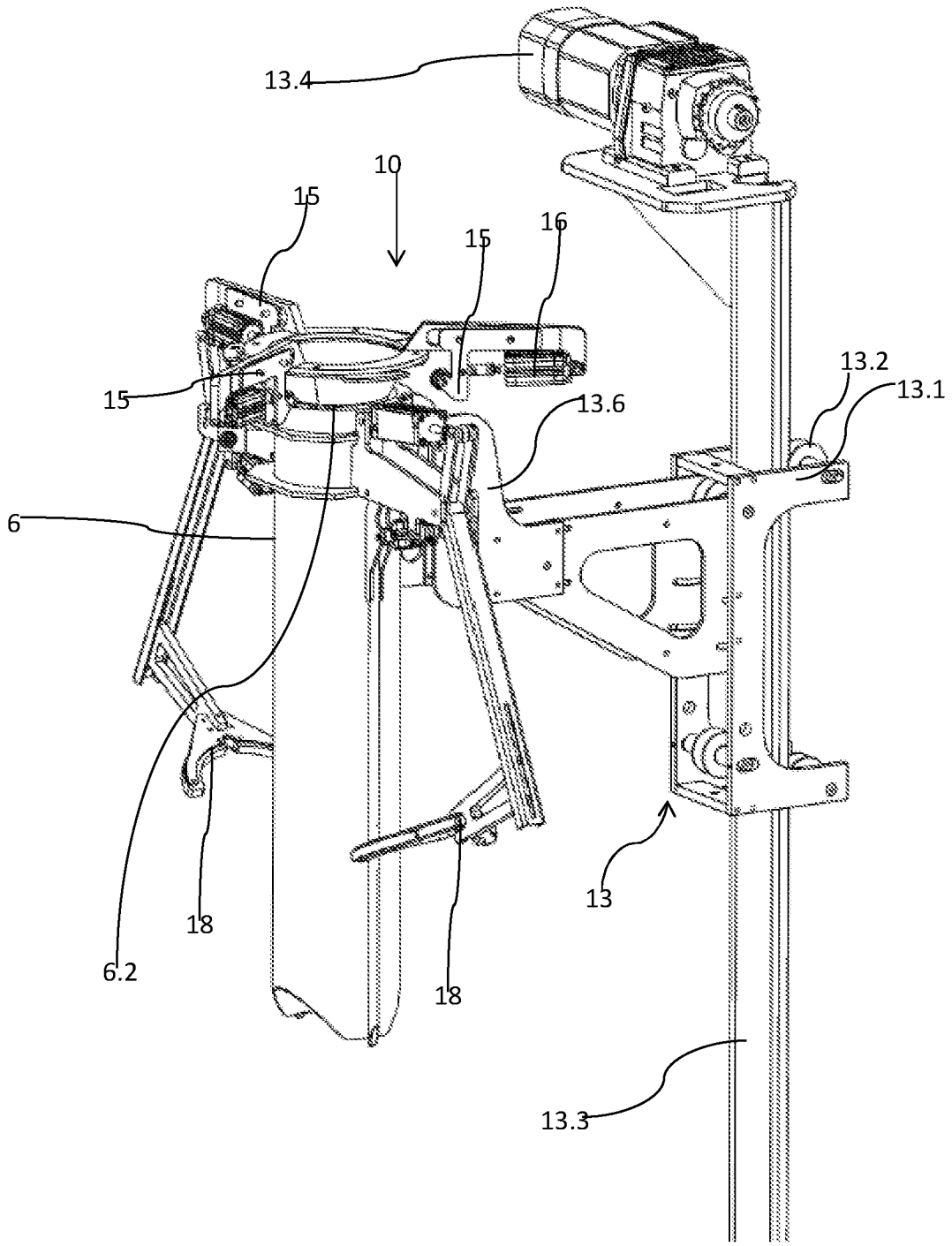
FIG. 5 shows an enlarged section from FIG. 4 with a 3-D representation of the elevator part in its uppermost position.

Via a fixture 13.6, best shown in FIG. 5, the elevator carriage 13.1 is permanently attached to the outer pipe 6 and as shown in FIG. 2 the outer pipe can be moved up and down on the outside of the inner pipe 5 to a position shown in FIG. 5. Here the upper rim 6.2 of the outer pipe 6 goes to the underside of the outward facing coned part of the feed pipe 5. In this position, the clamps 15 can release the feed pipe so that it is no longer attached to bracket 10. When the elevator carriage is then moved downwards, the feed pipe will follow. The elevator 13 can be driven all the way down to floor level, and so the feed pipe 5 can be manually removed and another feed pipe attached, normally of a different length. Alternatively, intermediate sections can be attached and removed as illustrated in FIG. 8

Thereafter the elevator is driven up to bracket 10 and the clamps 15 activated so that the new pipe is attached to the bracket—the elevator can now simply be driven down and operations continued in accordance with the outer pipe's different work positions during filling as previously explained.

FIG. 12 shows that the outward facing upper flange 5.3 on the bottom feed pipe 5.5 and the intermediate sections 5.2 has cutouts 5.7. Corresponding to each cutout, there is a pin 5.8 attached to the underside of the bottom flange 5.6, on the intermediate sections 5.2. On the pin 5.8 and locking arm 5.9 is attached on the upper side of the flange 5.6. The locking arm 5.9 allows the pin 5.8 to move downwards so that this can be fed into a cutout 5.7 and then attached and locked in one position where the pin 5.8 pulls the upper flange 5.3 into the underside of the lower flange 5.6. The locking arm 5.9 is shown with a handle for adjustment between the release/locking of the pin 5.8. When two pipe sections are to be attached, the lower flange 5.6 is attached to the upper flange 5.3 on another pipe, in that each of the three pins 5.8 is placed outside of their own cutouts 5.7 as can be seen in the middle illustration in FIG. 12, thereafter the two pipes are turned in relation to each other such that the pin is pushed into the bottom of the cutout 5.7 as shown in the illustration on the right in FIG. 12. In this position the locking arm 5.9 is brought down so that there is permanent tension between the pin 5.8 and the locking and 5.9 and the two pipe sections are firmly locked to one another.

From the underside of the bottom feed pipe 5.5 up a flange 5.3 is signal pin 19 is fitted which can also be seen in FIG. 11 and FIG. 12. Here the function is shown, as the pin connection to a signal sender 20 fitted to the upper rim of the upper pipe 6. Only if the signal sender 20 is activated by the signal pin 19 is the actuator 16 permitted to release the clamps 15 to release the collective feed pipe from the bracket 10 on the underside of the dosage unit 8. The activation of signal sender 20 can also be used to stop further movement upwards of the elevator 13, so that this does not move further up than the interface between the outer pipe 6 upper rim 6.2 and the conical part on the bottom feed pipe.

To keep the different parts together and to bear the weight of the dosage unit, the system is supported by a regular machine frame 17. The elevator 13 is attached to the machine frame 17, and even on older systems the elevator 13 can be attached up to bracket 10 without major alterations to machine frame 17. The advantage here is that with the invention it is possible to rebuild older systems without replacing the machine frame and the dosage unit. With the invention's easy method for changing the feed pipe length it is thereby possible to use big bags of varying heights, without compromising space requirements for e.g. robot assisted handling of big bags. This means that on newer or older systems, a robot unit 14 can easily be fitted as shown in FIG. 1, and this will be able to be used for both shorter and taller big bags and the alterations required to the system to move from one sought to the other are easy to carry out, as personnel are able to do this task without having to lift or manoeuvre heavy feed pipes at a height.

Shown in several of the figures are the retaining arms 18, that are used to retain the big bag's neck 3 on the outer pipe during filling. It is generally known how to synchronise robot movements, to pick up empty big bags from the magazine and to place them on the outer pipe to be held by the retaining arms 18 and other parts of the filling system, so that a fully automatic system is achieved, leading to significant savings compared to slower filling systems, where big bags are presently placed manually.

Naturally, there are alternative methods of adapting systems to different heights of big bag: It is possible to raise or lower the underlying surface 7 of the dosage unit in order to achieve the optimal distance between the underlying surface and the bottom rim of the feed pipe; however, these types of solution are expensive in relation to the solution provided by the invention, where practically all parts of older systems remain unaffected, and at the same time a significant increase in flexibility and productivity is achieved.

REFERENCE NUMBERS

1 System for filling of big bags
2 Bottom
3 Neck
4 Big bag
5 Feed pipe
- 5.1 Feed pipe of a different length
- 5.2 Section of feed pipe
- 5.3 Outward facing upper flange
- 5.4 Downward facing rim
- 5.5 Bottom section
- 5.6 Bottom flange
- 5.7 Cutouts
- 5.8 Pin
- 5.9 Locking arm

6 Outer pipe
- 6.1 Mouth of outer pipe
- 6.2 Upper rim of outer pipe

7 Underlying surface
8 Dosage unit
8.1 Funnel shaped pipe section
8.2 Radial flange
9 Bottom rim of feed pipe
10 Bracket
11 Underside of dosage unit
12 Carousel magazine
12.1 Space in carousel magazine
12.2 Vertical axis
12.3 Slider
12.4 U-shaped clamp
13 Elevator
13.1 Elevator carriage
13.2 Wheels
13.3 Vertical rails
13.4 Drive motor
14 Robot unit
15 Clamps
16 Actuator
17 Machine frame
18 Retaining arm
19 Signal pin
20 Signal sender

The invention claimed is:

1. A method for adjustment of a system for filling of one or more big bags with material, comprising:

locating and retaining a neck of one of the big bags in an airtight seal around a feed pipe having a telescopically attached outer pipe, wherein the outer pipe is movable to a position corresponding to the height of the big bag, filling a predetermined quantity of material in a vertical stream through the feed pipe from an overlying dosage unit positioned above the feed pipe, supporting the bottom of the big bag on an underlying surface while carrying out the filling of material into the big bag, separating the neck of the big bag from the outer pipe after filling the big bag, and adjusting the distance between a bottom rim of the feed pipe and the dosage unit when changing from the big bag having a first height between the underlying surface and the neck to a different height big bag having a second height between the underlying surface and the neck.

2. The method according to claim 1, wherein the distance is adjusted by the feed pipe being detached from a bracket on the underside of the dosage unit and that a different length feed pipe being attached to the bracket.

3. The method according to claim 2, wherein the feed pipe is detached from the bracket and attached to a carousel magazine in an empty holder therein, and wherein the carousel magazine is turned and the different length feed pipe is brought from another holder in the carousel magazine and attached to the bracket.

4. The method according to claim 2, wherein the outer pipe is lifted along the feed pipe to an upper outward facing flange of the outer pipe, whereinafter the feed pipe is released from the bracket and carried by the outer pipe, whereinafter the outer pipe is brought down until the bottom rim of the feed pipe is at the same level as the underlying surface, whereinafter the feed pipe is lifted out of the outer pipe and the different length feed pipe is placed in the outer pipe, whereinafter the different length feed pipe is lifted up to the bracket and is attached there.

5. The method according to claim 1, wherein the distance between the feed pipe and the underlying surface is increased or decreased by replacing a section of the feed pipe with a shorter or longer section, or by that section of feed pipe is added or a section of feed pipe is removed.

* * * * *